US011918031B2

(12) United States Patent
Pastore et al.

(10) Patent No.: US 11,918,031 B2
(45) Date of Patent: Mar. 5, 2024

(54) METHOD FOR APPLYING AN ADHESIVE ON A WRAPPING BAND OF A SMOKING ARTICLE

(71) Applicant: G.D S.p.A., Bologna (IT)

(72) Inventors: Fulvio Pastore, Anzola (IT); Giuliano Gamberini, Crevalcore (IT); Emanuele Giovannini, Casalecchio di Reno (IT); Michele Ferioli, Bologna (IT); Massimo Sartoni, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 414 days.

(21) Appl. No.: 16/622,116

(22) PCT Filed: Jun. 12, 2018

(86) PCT No.: PCT/IB2018/054228
§ 371 (c)(1),
(2) Date: Dec. 12, 2019

(87) PCT Pub. No.: WO2018/229642
PCT Pub. Date: Dec. 20, 2018

(65) Prior Publication Data

US 2020/0178594 A1 Jun. 11, 2020

(30) Foreign Application Priority Data

Jun. 14, 2017 (IT) ..... 102017000065691

(51) Int. Cl.
*A24C 5/00* (2020.01)

(52) U.S. Cl.
CPC ..... *A24C 5/005* (2013.01)

(58) Field of Classification Search
CPC ..... A24C 5/005; A24C 5/24
(Continued)

(56) References Cited

U.S. PATENT DOCUMENTS 4,277,301 A * 7/1981 McIntyre ..... B65C 3/12 156/446
4,710,257 A * 12/1987 Mattei ..... B65B 51/026 118/221

(Continued)

FOREIGN PATENT DOCUMENTS

CN 1318330 A 10/2001
CN 1522798 A 8/2004

(Continued)

OTHER PUBLICATIONS

English language machine translation of CN-102697174-A, 2022.*

(Continued)

*Primary Examiner* — Dionne W. Mayes
(74) *Attorney, Agent, or Firm* — Timothy J. Klima; SHUTTLEWORTH & INGERSOLL, PLC

(57) ABSTRACT

A method for applying adhesive on a wrapping band of a smoking article includes moving the band along a feed direction, the band has a longitudinal direction of extension, opposing first and second surfaces, a first plurality of portions having a first thickness and a second plurality of portions having a second thickness greater than the first thickness, the portions of the first and second pluralities being disposed alternately along the direction of extension. A nozzle having a delivery end, and the band are moved towards/away from each other between a first position, where the delivery end and the second surface are at a first distance which is less than or equal to the second thickness, and a second position, where the delivery end and the second surface are at a second distance greater than the second thickness. An adhesive is delivered on the first surface through the nozzle.

12 Claims, 9 Drawing Sheets

(58) Field of Classification Search
USPC ..... 156/446; 131/69
See application file for complete search history.

(56) References Cited

U.S. PATENT DOCUMENTS

| | | | | |
|---|---|---|---|---|
| 5,222,509 | A | 6/1993 | Imai | |
| 2001/0032697 | A1* | 10/2001 | Maiwald | A24C 5/24 156/213 |
| 2011/0168195 | A1 | 7/2011 | Oliveira | |
| 2015/0114543 | A1* | 4/2015 | Riedel | B05C 5/0233 239/548 |
| 2015/0128858 | A1* | 5/2015 | Mimura | H01L 21/67253 118/699 |
| 2015/0352587 | A1* | 12/2015 | Ichino | B05C 11/1002 427/286 |

FOREIGN PATENT DOCUMENTS

| | | | | |
|---|---|---|---|---|
| CN | 1192726 | A | 3/2005 | |
| CN | 102697174 | A * | 10/2012 | A24C 5/24 |
| CN | 102697174 | A | 10/2012 | |
| CN | 102726835 | A | 10/2012 | |
| CN | 202697694 | U | 1/2013 | |
| CN | 103025180 | A | 4/2013 | |
| CN | 105358260 | A | 2/2016 | |
| CN | 105876853 | A | 8/2016 | |
| DE | 10019930 | A1 | 10/2001 | |
| EP | 1891865 | A1 | 2/2008 | |
| EP | 2799154 | A1 | 11/2014 | |
| IT | BO2000A000035 | | 1/2000 | |
| JP | S5637073 | A | 4/1981 | |
| JP | 2005052821 | A | 3/2005 | |
| JP | 2009226284 | A | 10/2009 | |
| WO | 2014019804 | A2 | 2/2014 | |

OTHER PUBLICATIONS

Chinese Office Action dated Jun. 7, 2021 from counterpart Chinese Patent Application No. 201880039671.5.

International Search Report and Written Opinion dated Oct. 2, 2018 for counterpart International Patent Application No. PCT/IB2018/054228.

Japanese Office Action dated Jun. 10, 2022 from counterpart Japanese Patent No. 2019-569708.

Korean Office Action dated Aug. 28, 2023 from counterpart Korean App No. 10-2020-7001227.

* cited by examiner

METHOD FOR APPLYING AN ADHESIVE ON A WRAPPING BAND OF A SMOKING ARTICLE

This application is the National Phase of International Application PCT/IB2018/054228 filed Jun. 12, 2018 which designated the U.S.

This application claims priority to Italian Patent Application No. 102017000065691 filed Jun. 14, 2017, which application is incorporated by reference herein.

TECHNICAL FIELD

This invention addresses the technical field relating to the application of adhesive on a wrapping band of a smoking article. More specifically, this invention relates to a method for applying the adhesive discontinuously on a wrapping band of a smoking article.

BACKGROUND ART

As is known, a smoking article may comprise, in this order, a segment of filter material, a segment of smokable material (for example tobacco), a heating element to heat the smokable material. Also, the segment of filter material, the segment of smokable material and the heating element are wrapped in a wrapping material.

In order to wrap the segments of the smoking article in the wrapping material, it is common practice to apply glue on a wrapping band which is subsequently cut.

The wrapping band therefore comprises first portions, consisting of portions of wrapping band, alternated with second portions, consisting of portions of wrapping band overlaid with strips of glue; these strips of glue are used to glue the wrapping material onto itself in order to wrap the smoking article segments. Thus, the second portions of wrapping band are thicker than the first portions of wrapping band.

The heating element of the aforementioned smoking article is located at one end of the smoking article. To prevent it from becoming detached from the segment of smokable material, it must be glued to the wrapping material. For this purpose, it is necessary to apply strips of adhesive (substantially parallel to the direction of extension of the wrapping band) on the first portions of wrapping band and these strips of adhesive must not interfere with the strips of glue already present on the second portions of wrapping band.

A method for applying an adhesive on a wrapping band of a smoking article is known from the device described in Italian patent document BO2000A000035. This prior art device comprises feed means for moving the wrapping band along a feed direction parallel to its direction of extension and at least one nozzle to deliver the adhesive on the wrapping band.

This prior art device does not, however, allow the adhesive to be applied continuously on the wrapping band. In detail, continuous application is interrupted only periodically to clean the nozzle.

Supposing the adhesive is delivered on the wrapping band described above (with first portions alternated with second portions), the nozzle might be disposed in contact with the first portions of wrapping band: in such a case, however, it would interfere with the strips of glue on the second portions of wrapping band. Alternatively, the nozzle might be disposed far enough away from the wrapping band as not to come into contact with the strips of glue on the second portions of wrapping band: in such a case, however, the nozzle would be too far from the wrapping band to be able to deliver the adhesive with the right degree of precision.

As a result, during the formation of the smoking article, the adhesive might also come into contact with the segment of smokable material, thereby negatively altering its flavour.

DISCLOSURE OF THE INVENTION

This invention has for an aim to provide a method for applying an adhesive discontinuously on a wrapping band of a smoking article to overcome the above mentioned disadvantage. More specifically, the aim of this invention is to provide a method which allows the adhesive to be applied precisely and accurately on a wrapping band made up of portions of different thicknesses.

The above aim is achieved by a method according to the accompanying claims.

BRIEF DESCRIPTION OF THE DRAWINGS

The invention is described below with reference to the accompanying drawings, which illustrate non-limiting embodiments of it, and in which.

DETAILED DESCRIPTION OF PREFERRED EMBODIMENTS OF THE INVENTION

Figure 1:
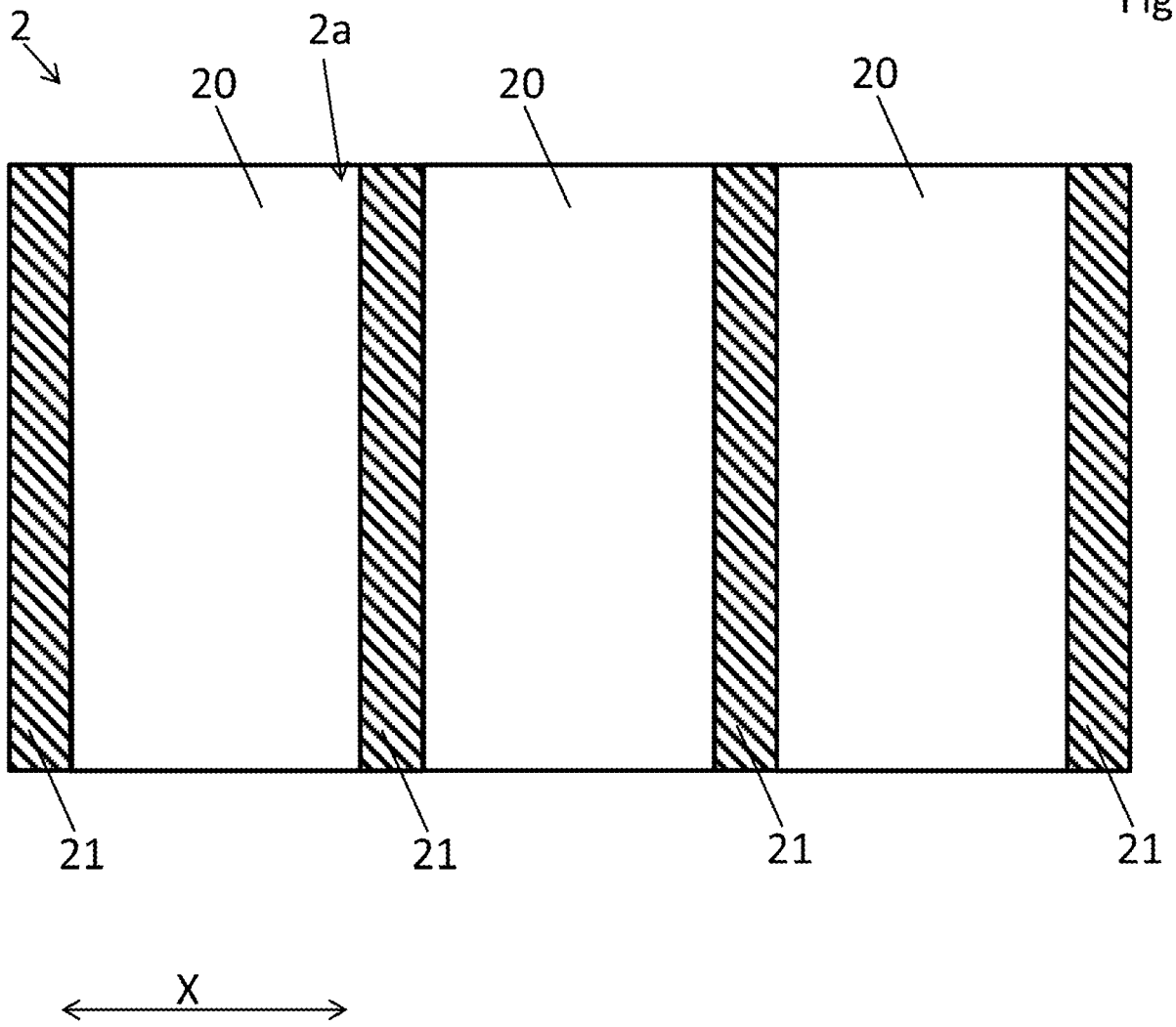
FIGS. 1 and 2 are top views of a portion of a wrapping band of a smoking article respectively before and after adhesive has been applied on it.

With reference to the accompanying drawings, the reference numeral 1 generically denotes a device which applies adhesive discontinuously on a wrapping band 2 of a smoking article and which is capable of implementing a method according to this invention.

The term "smoking article" is used to mean an article of the tobacco industry such as a cigarette or, more generally speaking, a cylindrically shaped element having a longitudinal axis of extension. For example, the smoking article might comprise, in this order: a segment of filter material, a segment of smokable material (for example tobacco based) and a heating element. The smoking article also comprises a wrapping wrapped completely or partly around the segments making up the smoking article. The wrapping is obtained from a strip of wrapping material which is in turn obtained from a wrapping band.

The wrapping band 2 (or sheet of wrapping material) has a longitudinal direction of extension X and can be roll-fed. The wrapping band 2 has a first surface 2*a* and a second surface 2*b* which are opposite to each other.

Figure 1A:
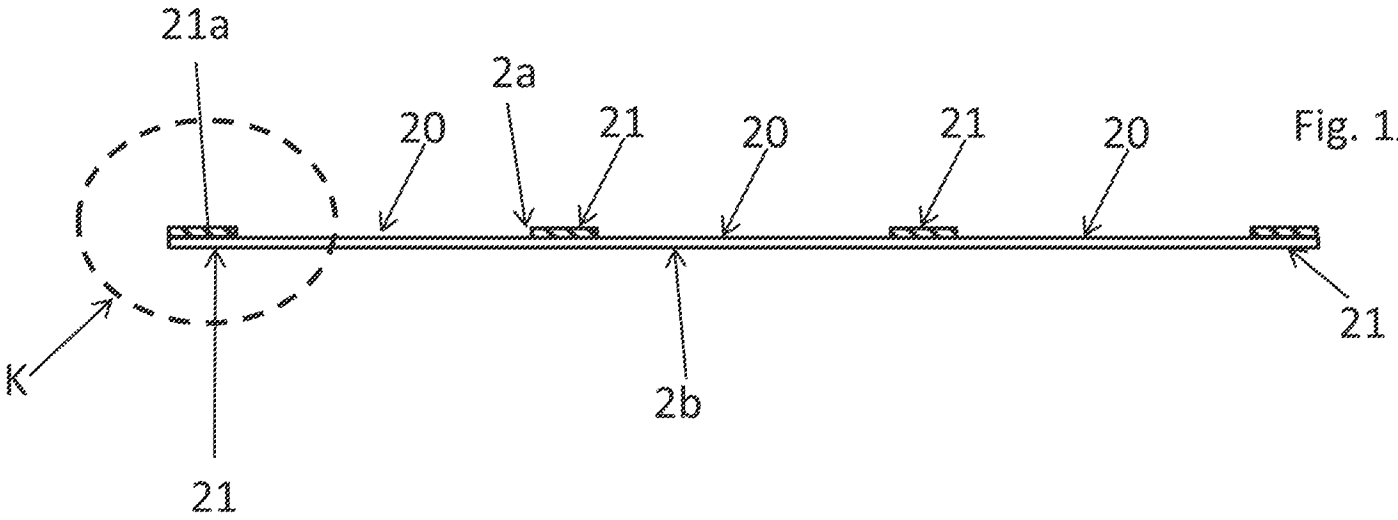
FIGS. 1A and 2A are side views of FIGS. 1 and 2, respectively.
Figure 3:
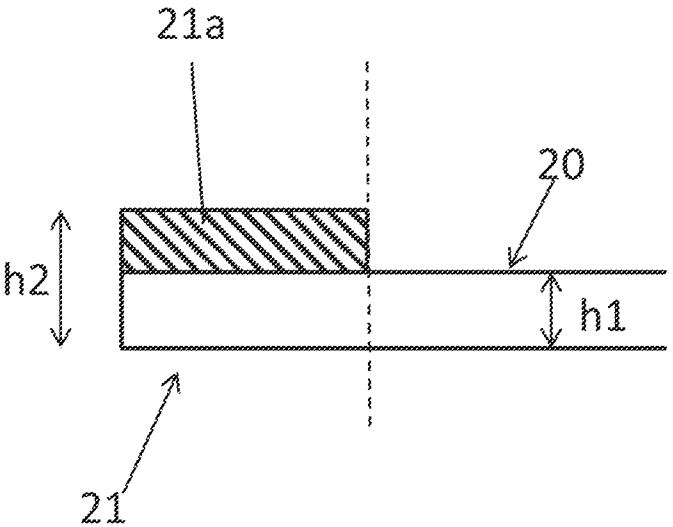
FIG. 3 shows an enlarged detail K from FIG. 1A.
Figure 2:
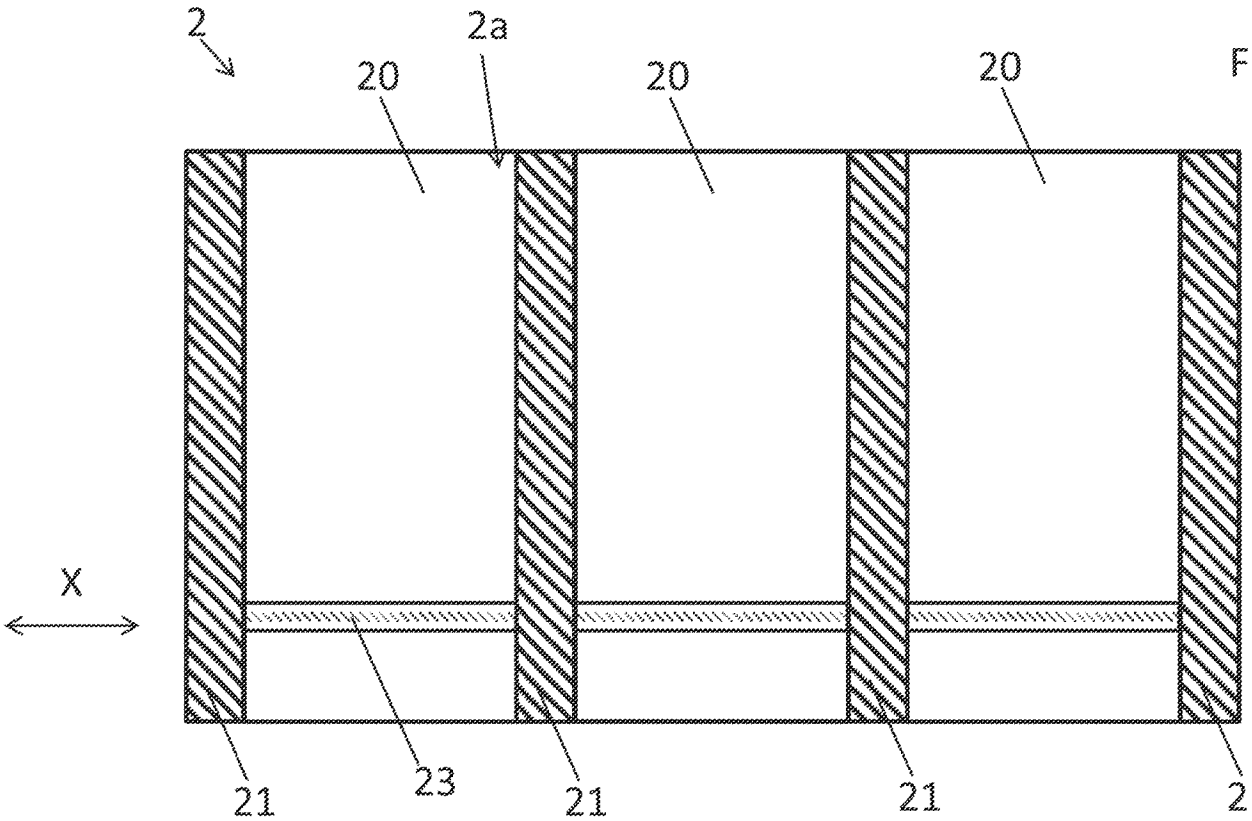
Figure 2A:
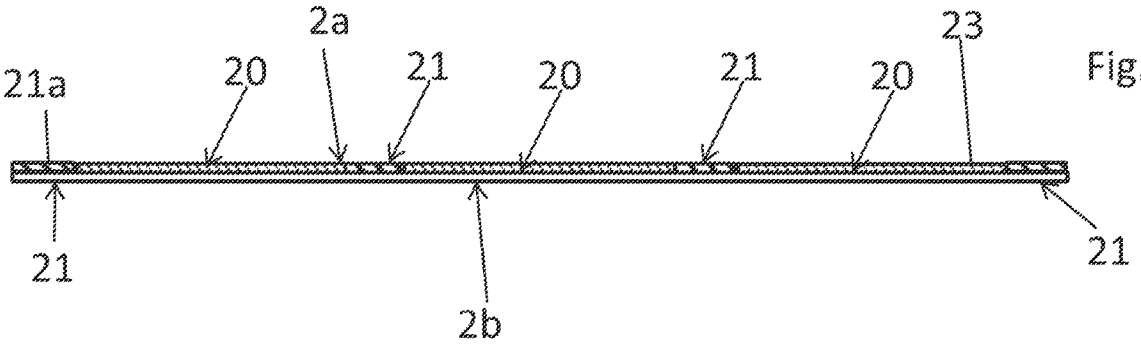
Figure 4A:
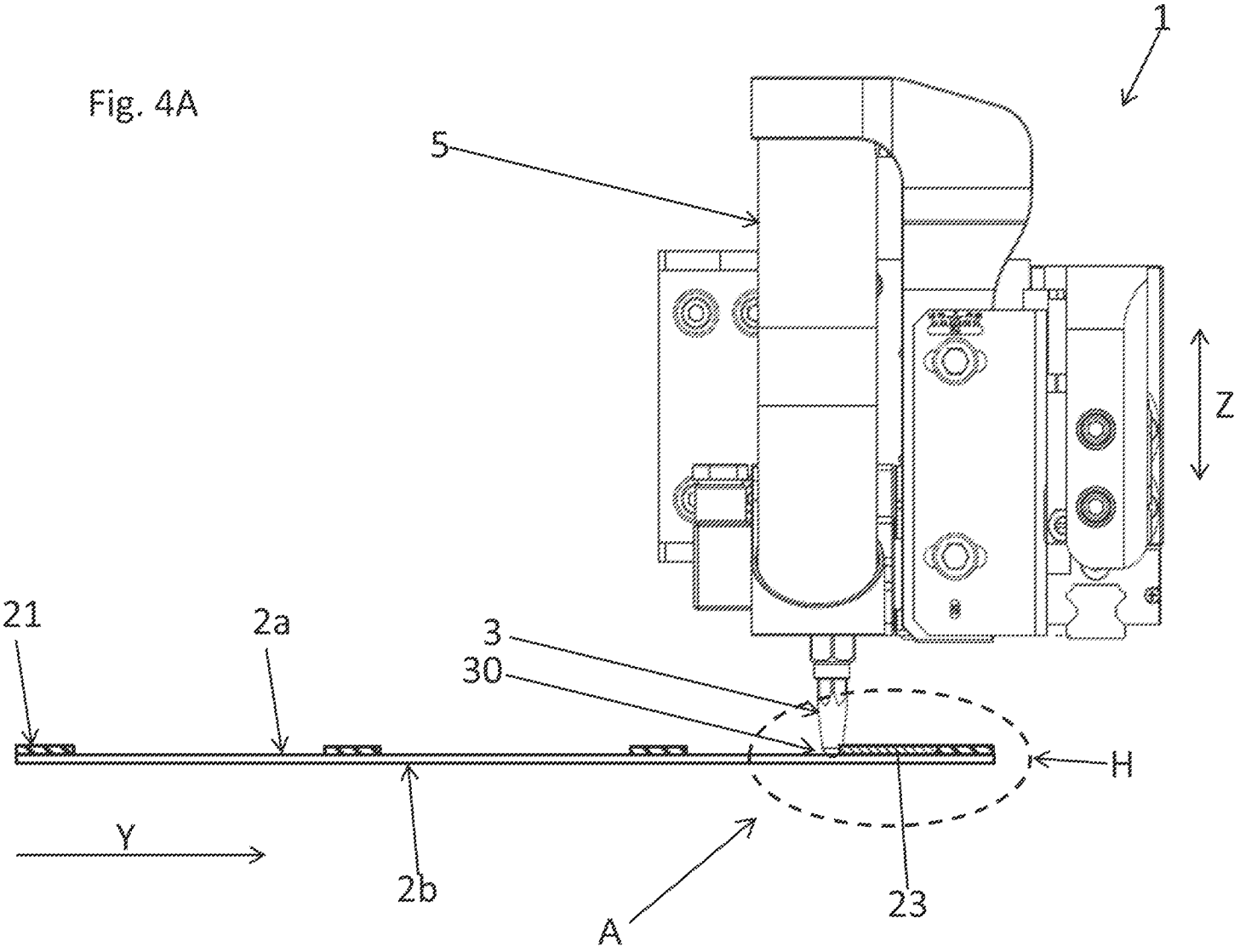
FIGS. 4A-4C are side views of an embodiment of a device capable of implementing the method according to this invention and of the wrapping band of FIG. 1 during respective steps of applying the adhesive.
Figure 4B:
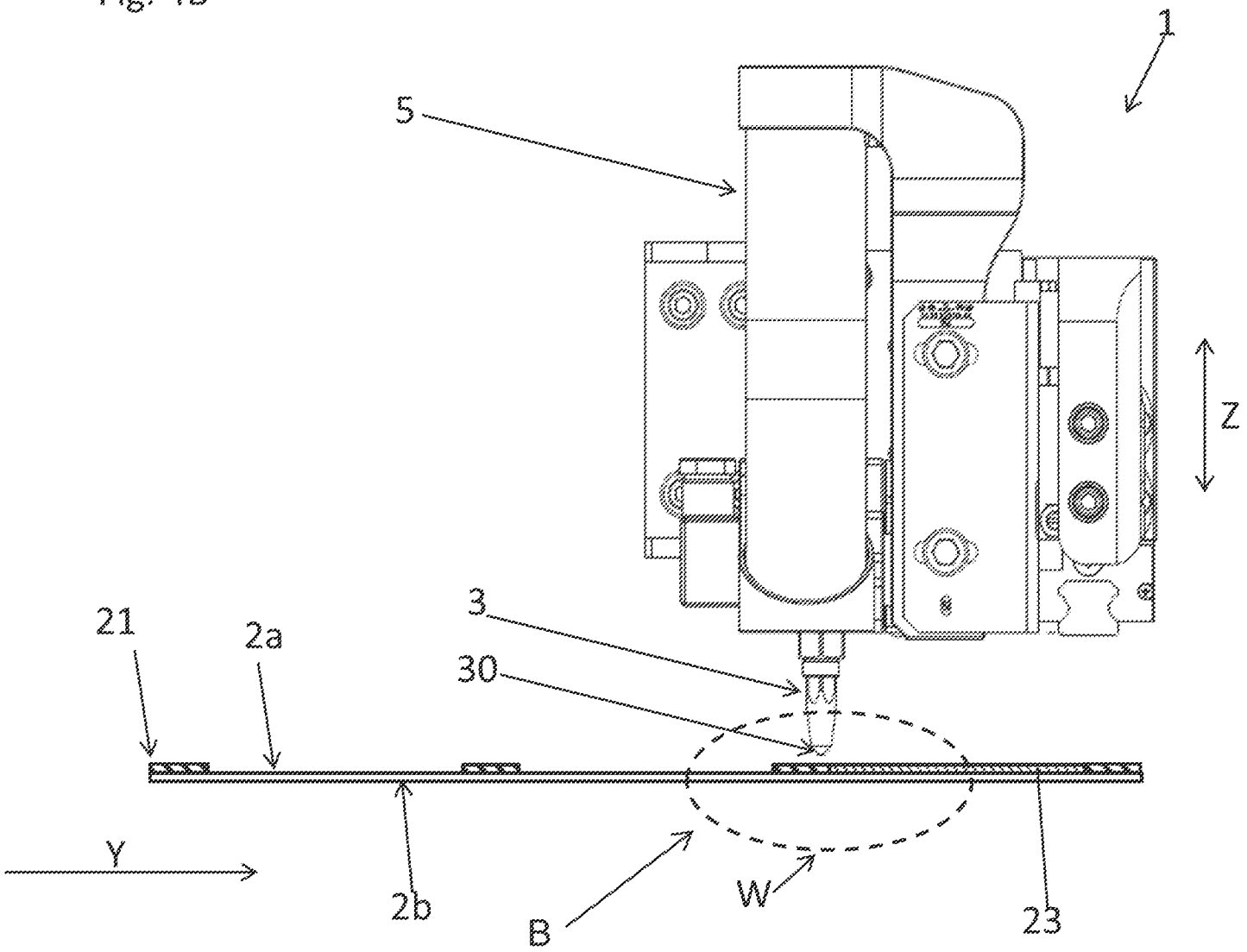
Figure 4C:
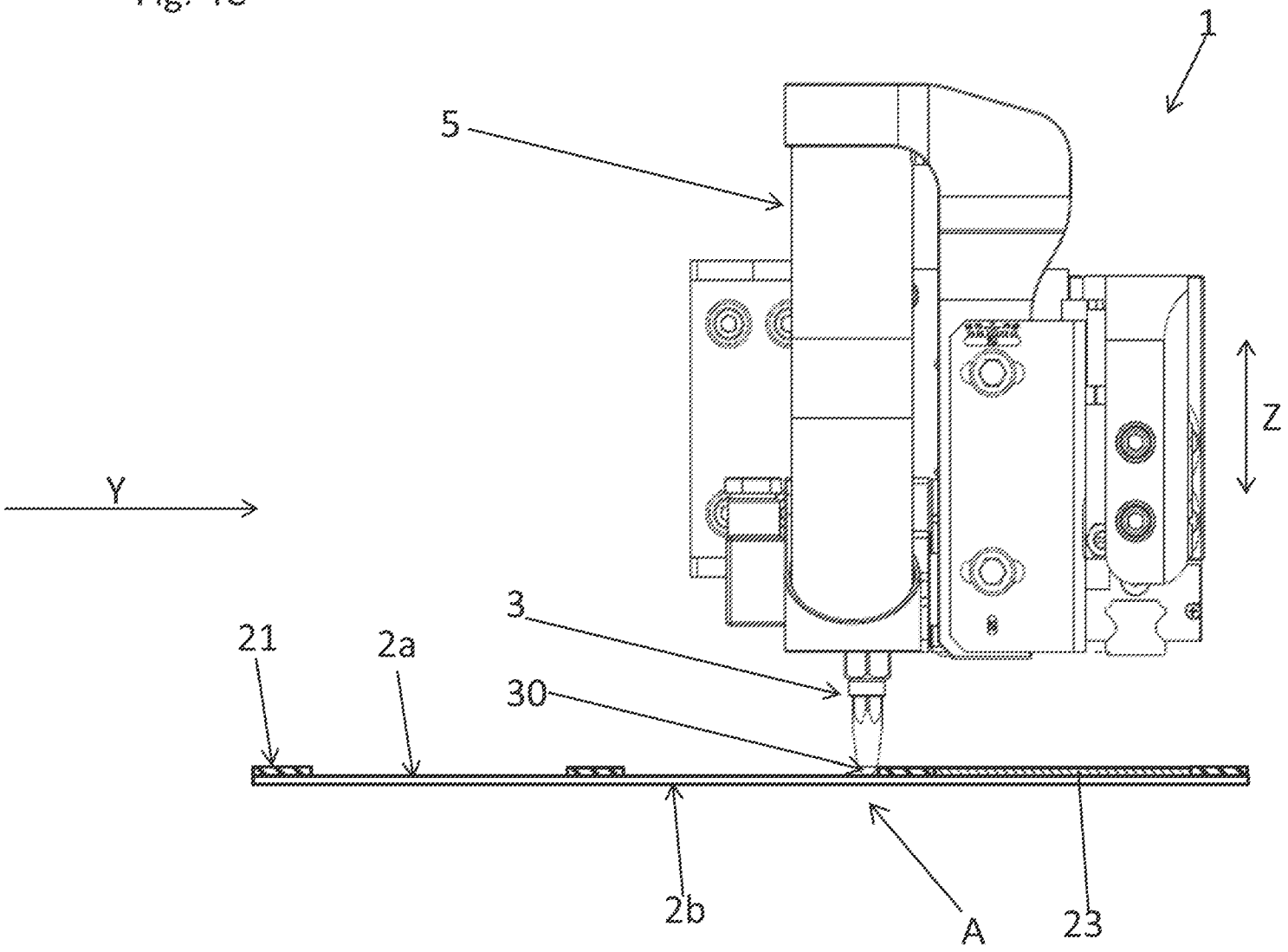
Figure 5:
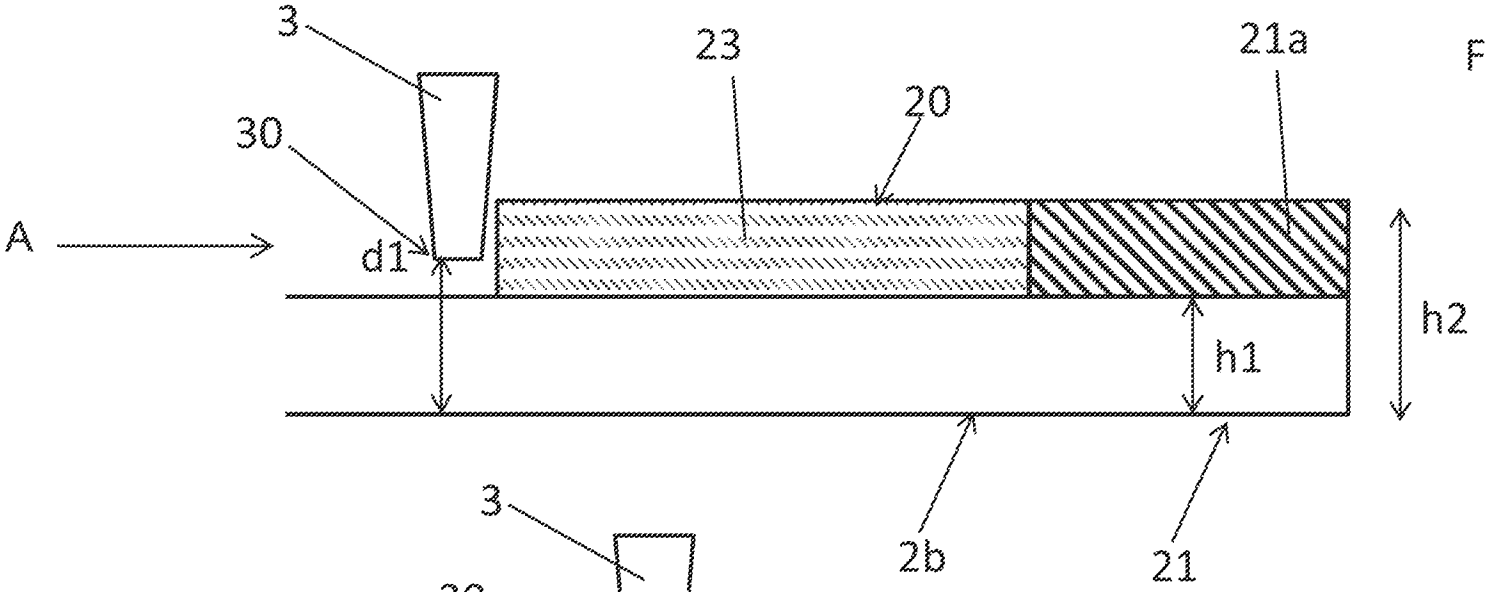
FIGS. 5 and 6 are enlargements of the detail H from FIG. 4A and of the detail W from FIG. 4B, respectively.

With reference in particular to FIGS. 1, 1A and 3, the wrapping band 2 comprises a first plurality 20 of portions having a first thickness h1 and a second plurality 21 of portions having a second thickness h2 greater than the first thickness h1. The portions of the first plurality 20 and the portions of the second plurality 21 are disposed alternately with each other along the direction of extension X of the wrapping band 2.

With reference in particular to FIG. 1, the portions of the first plurality 20 consist of parts of wrapping band, while the portions of the second plurality 21 consist of parts of wrapping band with strips of glue 21*a* (or adhesive) disposed on the first surface 2*a*. In detail, each strip of wrapping material comprises at least a part of the strips of glue 21*a*: that way, when the wrapping is placed round the smoking article, the strip of glue 21*a* on it is substantially parallel to the axis of extension of the smoking article.

Further, in one embodiment of the wrapping band not illustrated, each portion of the first plurality 20 may comprise at least one aluminium strip fixed to the first surface 2*a* and disposed substantially parallel to the direction of extension of the wrapping band 2. In such a case, each strip of wrapping material comprises the aluminium strip: in the wrapping placed round the smoking article, the aluminium strip is wrapped around the heating element of the smoking article.

The wrapping band 2 has a length along the direction of extension X, a width at right angles to the length and constant along the full length of the wrapping band 2 and a thickness which varies along the wrapping band 2 as described above. For example, the length of each portion of the first plurality 20 may be included in a range of 19-21 millimetres, while the length of each portion of the second plurality 21 may be included in a range of 6-8 hundredths of a millimetre The above described embodiments of the wrapping band 2 are preferred embodiments of the wrapping band 2 which can be used with the device 1. It is understood, however, that the device 1 can be used advantageously also with wrapping bands 2 different from that described above.

Described below with reference to FIGS. 4A-7 is a first preferred embodiment of the device 1, which is capable of implementing the method of this invention.

The device 1 comprises feed means for moving the wrapping band (2) along a feed direction Y parallel to the direction of extension X and a pair of nozzles 3, 8 (FIG. 7), each having a delivery end 30 for delivering an adhesive (for example, glue) on the first surface 2*a* of the wrapping band 2.

Figure 7:
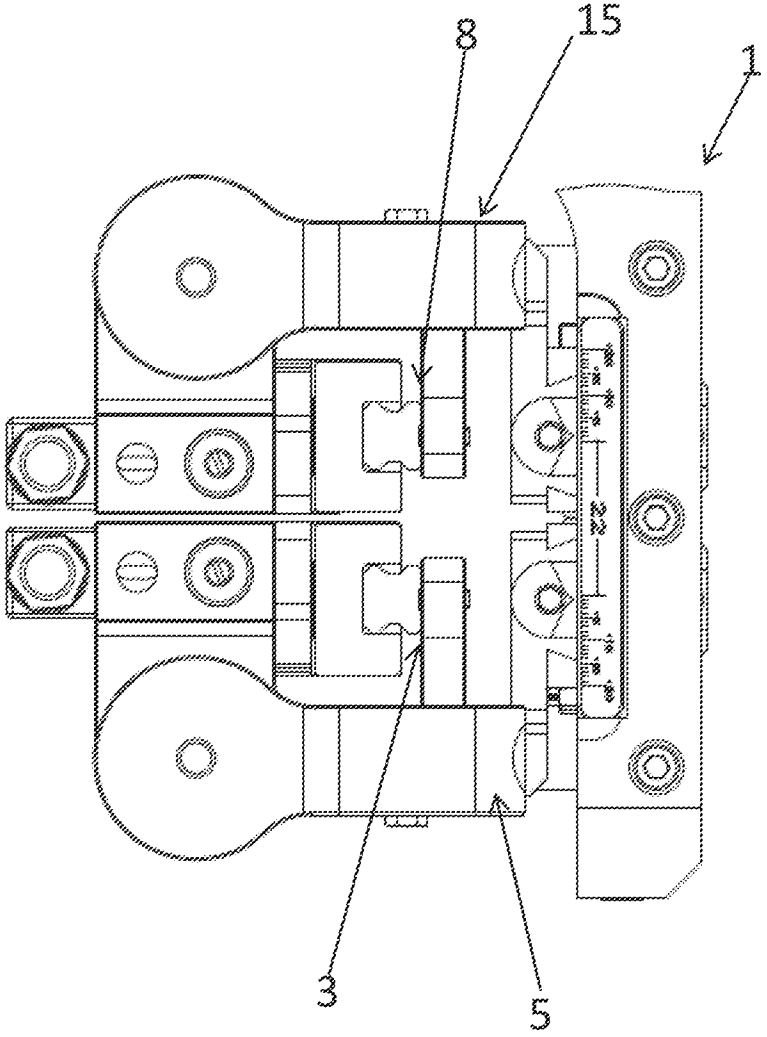
FIG. 7 is a top view of the device of FIGS. 4A-4C.

With reference in particular to FIG. 7, the first nozzle 3 and the second nozzle 8 are disposed side by side in a direction at right angles to the feed direction Y so as to be able to deliver parallel strips of adhesive 23 on the first surface 2*a* of the wrapping band 2. In such a case, the strips of wrapping obtained from the wrapping band 2 are large enough to wrap a pair of smoking articles which will subsequently be separated by cutting.

It is understood that everything described below with reference to the pair of nozzles 3, 8 also applies to the case where the device comprises only one of the nozzles 3, 8. In such a case, the strips of wrapping obtained from the wrapping band 2 are large enough to wrap a single smoking article.

The nozzles 3, 8 and the wrapping band 2 are movable towards and way from each other between a first position A, where the delivery ends 30 of the nozzles 3, 8 and the second surface 2*b* of the wrapping band 2 are at a first distance d1 which is less than or equal to the second thickness h2, and a second position B where the delivery ends 30 of the nozzles 3, 8 and the second surface 2*b* of the wrapping band 2 are at a second distance d2 which is greater than the second thickness h2.

The term "distance" means the distance of the delivery ends 30 of the nozzles 3, 8 from the second surface 2*b* of the wrapping band 2.

Figure 6:
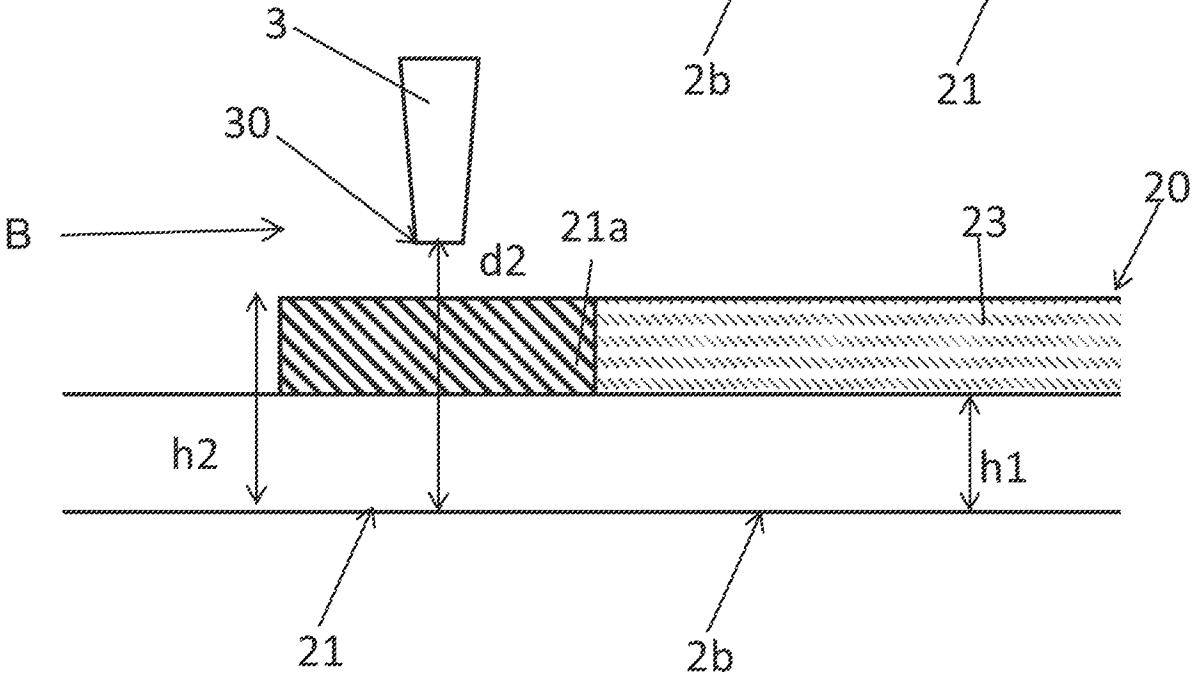

The device 1 comprises movement means 4 for moving the nozzles 3, 8 and the wrapping band 2 between the first position A and the second position B so that they are at the first position A when the delivery ends 30 of the nozzles 3, 8 face a portion of the first plurality 20 (FIG. 5) and at the second position B when the delivery ends 30 of the nozzles 3, 8 face a portion of the second plurality 21 (FIG. 6).

In other words, when the delivery ends 30 of the nozzles 3, 8 face a portion of the first plurality 20, the movement means 4 move the nozzles 3, 8 and the wrapping band 2 closer together until they are at the first distance d1 (the first distance d1 being preferably equal to the first thickness h1, that is to say, the delivery ends 30 of the nozzles 3, 8 and the first surface 2*a* of the wrapping band 2 are disposed in contact with each other). On the other hand, when the delivery ends 30 of the nozzles 3, 8 face a portion of the second plurality 21, the movement means 4 move the nozzles 3, 8 and the wrapping band 2 away from each other until they are at the second distance d2 (the second distance d2 being such as to ensure that the delivery ends 30 of the nozzles 3, 8 are not disposed in contact with, that is to say, do not interfere with, any portion of the second plurality 21). Thus, the delivery ends 30 of the nozzles 3, 8 are never disposed in contact with the strips of glue 21*a* of the portions of the second plurality 21.

Advantageously, the proposed device 1 allows applying the adhesive precisely and accurately on a wrapping band 2 where the portions of the first plurality 20 and the portions of the second plurality 21 differ in thickness.

The feed means for feeding the wrapping band 2 are not illustrated in the drawings because they are commonly known to experts in the field (for example, they may comprise feed rollers and/or feed belts).

Preferably, the device 1 comprises a control unit (not illustrated) which is connected to the nozzles 3, 8 to control delivery of the adhesive by the nozzles 3, 8.

In detail, the control unit is configured to enable delivery of the adhesive through the nozzles 3, 8 when the nozzles 3, 8 and the wrapping band 2 are at the first position A and to prevent delivery of the adhesive through the nozzles 3, 8 when the nozzles 3, 8 and the wrapping band 2 are at the second position B.

Thus, when the delivery ends 30 of the nozzles 3, 8 face a portion of the first plurality 20 of the wrapping band 2, they are at the first position A and adhesive is allowed to issue from the nozzles 3, 8. On the other hand, when the delivery ends 30 of the nozzles 3, 8 face a portion of the second plurality 21 of the wrapping band 2, they are at the second position B and adhesive is prevented from issuing from the nozzles 3, 8. Advantageously, adhesive is thus applied precisely and accurately on the portions of the first plurality 20 of the wrapping band 2.

As mentioned above, in one particular embodiment of the wrapping band 2, the portions of the first plurality 20 may each comprise two aluminium strips (or one if there is only one nozzle) parallel to the direction of extension of the wrapping band 2. In such a case, the nozzles 3, 8 and the wrapping band 2 are mutually disposed to deliver adhesive at the aluminium strips. Advantageously, the heating elements of two smoking articles are glued to the wrapping at the aluminium strips.

The device 1 may be operated in such a way that the nozzles 3, 8 are controlled cyclically by the control unit. In other words, delivery of adhesive through the nozzles 3, 8 is allowed at regular time intervals and for a predetermined length of time: delivery of the adhesive through the nozzles 3, 8 is allowed only when the nozzles 3, 8 and the wrapping band 2 are at the first position A. This is possible because the feed speed of the wrapping band 2 is constant, as is the length of the portions of the first plurality 20 and the length of the portions of the second plurality 21.

Alternatively, the device 1 may comprise a sensor (for example, an optical sensor) to detect the portions of the first plurality 20 or, more precisely, to detect the start and end of the aluminium strips. The sensor is connected to the control unit so that when the sensor detects the start and end of the aluminium strips, the control unit allows or prevents delivery of the adhesive through the nozzles 3, 8.

Advantageously, the precision in applying the adhesive on the portions of the first plurality 20 is further improved.

In the first embodiment (FIGS. 4A-7), the movement means 4 comprise an actuator 5 for moving the nozzle 3 towards/away from the wrapping band 2. Similarly, the movement means 4 comprise another actuator 15 for moving the nozzle 8 towards/away from the wrapping band 2. The actuators 5, 15 are driven synchronously with each other.

In other words, the wrapping band 2 is moved along the feed direction Y while the nozzle 3 is moved towards/away from the wrapping band 2, that is, towards/away from the plane which the wrapping band 2 lies in.

Preferably, the nozzle 3 and the wrapping band 2 are movable towards/away from each other along a movement direction at right angles to the plane the wrapping band 2 lies in.

The actuator 5 (and/or the actuator 15) may be, for example, piezoelectric. Advantageously, this type of actuator 5, 15 ensures that the nozzles 3, 8 are driven at adequate speed. Alternatively, the actuator 5 (and/or the actuator 15) may be a linear motor.

Figure 8:
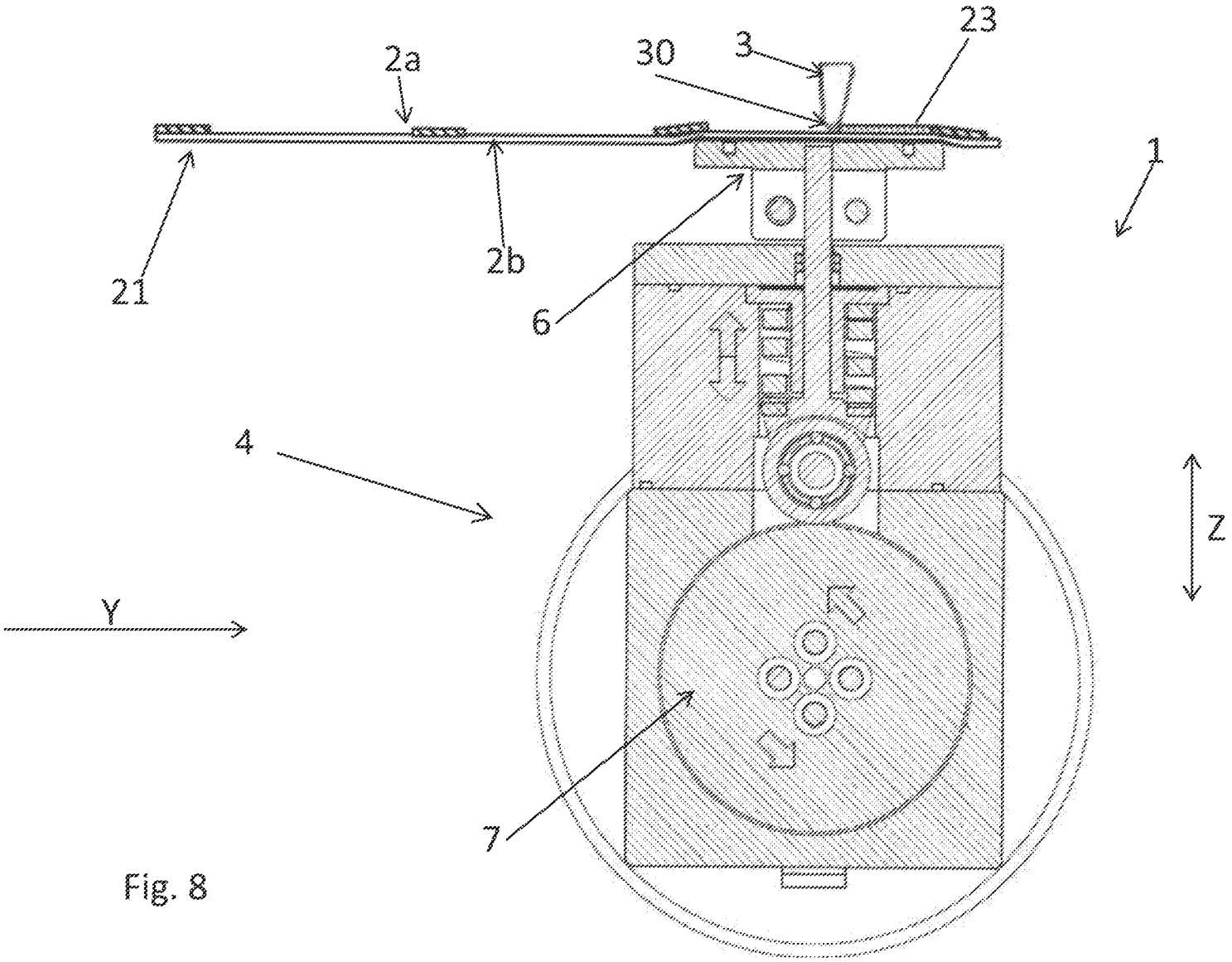
FIG. 8 is a side view in cross section of another embodiment of the device which is capable of implementing the method according to this invention.

FIG. 8 shows a second embodiment of the device 1. Compared to the embodiment described above, the second embodiment is provided with different movement means and comprises a single nozzle 3. It is, however, understood that in this case, too, there may be two or more nozzles.

In particular, with reference to FIG. 8, the movement means 4 comprise a supporting element 6 that faces the second surface 2*b* of the wrapping band 2 and that is movable in a direction Z transverse (preferably at right angles) to the plane of the wrapping band 2 in order to move the wrapping band 2 towards/away from the nozzle 3.

In other words, in the second embodiment, the nozzle 3 remains stationary relative to the wrapping band 2. The wrapping band 2, on the other hand, is moved both along the feed direction Y and in the direction Z transverse to the feed plane of the wrapping band 2.

The wrapping band 2, on the other hand, is moved in the direction Z transverse to the feed plane of the wrapping band 2 by lifting and lowering the supporting element 6. In detail, the supporting element 6 is lifted towards the nozzle 3 when the delivery end 30 of the nozzle 3 faces a portion of the first plurality 20 (FIG. 8). In the same way, the supporting element 6 is lowered away from the nozzle 3 when the delivery end 30 of the nozzle 3 faces a portion of the second plurality 21 (position not illustrated).

The supporting element 6 is shaped like a plate whose size is such as to allow it to come into contact with the full width of the wrapping band.

Also, the supporting element 6 may be provided with at least one opening. The opening might be a slot, for example at right angles to the feed direction Y. Alternatively, the supporting element 6 might comprise one or more holes.

The device 1 comprises air suction means disposed to take air in through the opening of the supporting element 6 so as to hold the wrapping band 2 in contact with the support element 6.

In the second embodiment, therefore, the wrapping band 2 remains in contact with the supporting element 6 at all times and the supporting element 6 is raised and lowered to move towards and away from the nozzle 3; consequently, the supporting element 6 moves the wrapping band 2 closer to or away from the nozzle 3.

Preferably, the movement means 4 comprise a cam 7 for moving the supporting element 6 in the direction transverse to the plane of the wrapping band 2 so as to move the wrapping band 2 towards/away from the nozzle 3.

Advantageously, the supporting element 6 is moved sufficiently quickly and precisely to ensure that the adhesive is delivered correctly on the portions of the first plurality 20.

It is understood that movement of the supporting element 6 may be obtained by different means known to an expert in the trade.

In an embodiment not illustrated, the movement means 4 can move both the nozzle 3 and the wrapping band 2 towards/away from each other. In such a case, for example, the device 1 may comprise the actuator 5 which moves the nozzle 3 and the supporting element 6 that faces the second surface 2*b* of the wrapping band 2.

According to this invention, a method for applying the adhesive on the wrapping band 2 for a smoking article using any one of the above described embodiments of the device 1, comprising the step of moving the wrapping band 2 along the feed direction Y, followed by the steps of:

disposing the nozzle 3 and the wrapping band 2 at the first position A (preferably disposing the delivery end 30 of the nozzle 3 in contact with a portion of the first plurality 20) and enabling adhesive to be delivered through the nozzle 3 when the delivery end 30 of the nozzle 3 faces a portion of the second plurality 20;

disposing the nozzle 3 and the wrapping band 2 at the second position B and preventing adhesive from being delivered through the nozzle 3 when the delivery end 30 of the nozzle 3 faces a portion of the second plurality 21.

The invention claimed is:

1. A method for applying an adhesive on a wrapping band of a smoking article, the smoking article comprising a segment of filter material and a segment of smokable material, wherein the method comprises the following steps:

moving the wrapping band along a feed direction, where the wrapping band has a longitudinal direction of extension, a first surface and a second surface opposed to the first surface; the wrapping band comprising a first plurality of portions having a first thickness and a second plurality of portions having a second thickness greater than the first thickness, wherein the first plurality of portions and the second plurality of portions are disposed alternately with each other along the direction of extension;

performing a relative movement between a nozzle, which has a delivery end, and the wrapping band towards and away from each other between a first position, where the delivery end of the nozzle and the second surface of the wrapping band are at a first distance which is less than or equal to the second thickness, and a second position, where the delivery end of the nozzle and the second surface of the wrapping band are at a second distance which is greater than the second thickness;

delivering an adhesive on the first surface of the wrapping band through the nozzle, when the nozzle and the wrapping band are at the first position and the delivery end of the nozzle faces a portion of the first plurality of portions;

wherein the step of performing the relative movement is performed in a manner synchronized with the first plurality of portions and with the second plurality of portions such that, when the delivery end of the nozzle faces the portion of the first plurality of portions, the delivery end is at the first position and adhesive is issued from the nozzle, and when the delivery end of the nozzle faces a portion of the second plurality of portions, the delivery end is at the second position; and providing a control unit connected to the nozzle to enable delivery of the adhesive through the nozzle, when the nozzle and the wrapping band are at the first position, and to prevent delivery of the adhesive through the nozzle, when the nozzle and the wrapping band are at the second position.

2. The method according to claim 1, and further comprising a step of detecting the first plurality of portions using a sensor.

3. The method according to claim 1, wherein the step of performing the relative movement between the nozzle and the wrapping band comprises a step of moving the nozzle towards and away from the wrapping band.

4. The method according to claim 1, wherein the step of performing the relative movement between the nozzle and the wrapping band comprises a step of moving the wrapping band towards and away from the nozzle.

5. The method according to claim 4, wherein the step of performing the relative movement comprises a step of moving a supporting element that faces the second surface of the wrapping band in a direction transverse to a plane of the wrapping band.

6. The method according to claim 5, and further comprising a step of taking air in through an opening of the supporting element to hold the wrapping band in contact with the supporting element.

7. The method according to claim 1, wherein the step of performing the relative movement is performed cyclically by delivering adhesive through the nozzle at regular time intervals and for predetermined lengths of time.

8. The method according to claim 7, wherein the wrapping band is moved at a constant speed along the feed direction and lengths of the first plurality of portions and lengths of the second plurality of portions are constant.

9. The method according to claim 1, wherein the first plurality of portions consist of parts of the wrapping band and wherein the second plurality of portions consist of parts of the wrapping band with strips of glue or adhesive disposed on the first surface.

10. A method for applying an adhesive on a wrapping band of a smoking article, the smoking article comprising a segment of filter material and a segment of smokable material, wherein the method comprises the following steps:

moving the wrapping band along a feed direction, where the wrapping band has a longitudinal direction of extension, a first surface and a second surface opposed to the first surface; the wrapping band comprising a first plurality of portions having a first thickness and a second plurality of portions having a second thickness greater than the first thickness, wherein the first plurality of portions and the second plurality of portions are disposed alternately with each other along the direction of extension;

performing a relative movement between a nozzle, which has a delivery end, and the wrapping band towards and away from each other between a first position, where the delivery end of the nozzle and the second surface of the wrapping band are at a first distance which is less than or equal to the second thickness, and a second position, where the delivery end of the nozzle and the second surface of the wrapping band are at a second distance which is greater than the second thickness;

delivering an adhesive on the first surface of the wrapping band through the nozzle, when the nozzle and the wrapping band are at the first position and the delivery end of the nozzle faces a portion of the first plurality of portions;

wherein the step of performing the relative movement is performed in a manner synchronized with the first plurality of portions and with the second plurality of portions such that, when the delivery end of the nozzle faces the portion of the first plurality of portions, the delivery end is at the first position and adhesive is issued from the nozzle, and when the delivery end of the nozzle faces a portion of the second plurality of portions, the delivery end is at the second position; and wherein the step of performing the relative movement between the nozzle and the wrapping band comprises a step of moving the wrapping band towards and away from the nozzle.

11. The method according to claim 10, wherein the step of performing the relative movement comprises a step of moving a supporting element that faces the second surface of the wrapping band in a direction transverse to a plane of the wrapping band.

12. The method according to claim 11, and further comprising a step of taking air in through an opening of the supporting element to hold the wrapping band in contact with the supporting element.

* * * * *